US005099754A

United States Patent [19]

Griepentrog

[11] Patent Number: 5,099,754

[45] Date of Patent: Mar. 31, 1992

[54] AIR DUCT

[75] Inventor: Joachim Griepentrog, Bergisch Gladbach, Fed. Rep. of Germany

[73] Assignee: Turbon-Tunzini Klimatechnik GmbH, Bergisch Gladbach, Fed. Rep. of Germany

[21] Appl. No.: 534,762

[22] Filed: Jun. 1, 1990

[30] Foreign Application Priority Data

Jun. 3, 1989 [DE] Fed. Rep. of Germany ..... 3918218

[51] Int. Cl.[5] ..... F24F 13/068

[52] U.S. Cl. ..... 454/298; 454/323

[58] Field of Search ..... 98/40.01, 40.05, 40.1, 98/40.11, 41.2, 41.3

[56] References Cited

U.S. PATENT DOCUMENTS

| | | | |
|---|---|---|---|
| 1,319,526 | 10/1919 | Hauser | 98/41.2 |
| 2,466,851 | 4/1949 | Hunerkamp et al. | 98/41.3 X |
| 3,537,380 | 11/1970 | Spradling et al. | 98/40.11 |
| 4,181,253 | 1/1980 | Barlow | 98/40.11 X |

FOREIGN PATENT DOCUMENTS

| | | | |
|---|---|---|---|
| 652914 | 11/1937 | Fed. Rep. of Germany | 98/40.11 |
| 2847017 | 11/1974 | Fed. Rep. of Germany | 98/40.11 |
| 255755 | 11/1987 | Japan | 98/40.01 |
| 172858 | 7/1988 | Japan | 98/40.11 |
| 186368 | 11/1963 | Sweden | 98/41.2 |

*Primary Examiner*—Harold Joyce
*Attorney, Agent, or Firm*—Max Fogiel

[57] ABSTRACT

An air duct has a perforated jacket (1) and a base (3) with air-outlet openings (3*a*) that can be closed off. One or more annular diaphragms (5 or 18*a* & 18*b*) travel up and down or rotate or travel up and down and rotate inside the jacket.

18 Claims, 17 Drawing Sheets

AIR DUCT

BACKGROUND OF THE INVENTION

The invention concerns an air duct, preferably with a cylindrical jacket.

A known air duct of this genus (German Patent 3 429 710) has several axially separated annular diaphragms that fit tightly into the jacket. The inside diameters of the diaphragms are progressively shorter the nearer they are to the base. Since the position of these diaphragms inside the jacket and the size of their aperture can be varied during the operation, the air duct can be adapted to various applications (heating or cooling). Even though this air duct has been proven in practice, it encounters problems when the temperature of the area being heated must differ extensively from that of the incoming air to rapidly heat up industrial areas that have cooled off overnight or over the weekend. In such a situation the uppermost annular diaphragm and the base, which is closed off, will divert the incoming air, which can accordingly flow out only at a downward slope. Thus, when the difference between the temperatures is extensive, the warm air cannot reach the areas where the personnel are located or to the floor.

SUMMARY OF THE INVENTION

The object of the invention is to modify the known air duct to the extent that the areas can be rapidly heated even when the temperature of the area being heated differs extensively from that of the incoming air.

This air duct makes it possible to adjust one or two annular diaphragms to divert the radially exiting jets of air up in the lower-temperature situation and prevent drafts in the vicinity of the personnel. When the area is being kept warm, either the diaphragm or pair of diaphragms will be lowered or the apertures in just the one pair will partly open to allow air to flow out and down at an angle.

When the area is being heated up, either the diaphragm or the pair of diaphragms will be lowered as far as possible or the apertures in the pair will open completely to allow the air to flow out and down at a steep slope. When the difference between the temperature of the area being heated and that of the incoming air is extensive, accordingly, the hot air leaving the air duct will travel directly to the floor, which, departing from the verticality of the outlet, it will continue to flow radially over without ascending to the ceiling until there is no longer any difference between the two temperatures.

When the temperature differences must be very extensive, additional openings of any identical shape, size, and position in the base of the air duct can be opened to allow the incoming air to flow down perpendicularly and rapidly and economically heat the space up. It is also possible to open the whole base up. When very extensive temperature difference are never necessary, there is no need for outflow openings in the base. When several variable annular diaphragms of pairs of diaphragms are employed, it must be possible to open the base to allow the hot air leaving the air duct to travel directly to the floor, and, departing from the verticality of the outlet, to flow radially over it without ascending to the ceiling until there is almost no difference between the two temperatures.

BRIEF DESCRIPTION OF THE DRAWINGS

Several embodiments of the invention will now be described with reference to the drawings, wherein.

DESCRIPTION OF THE PREFERRED EMBODIMENTS

Figure 1:
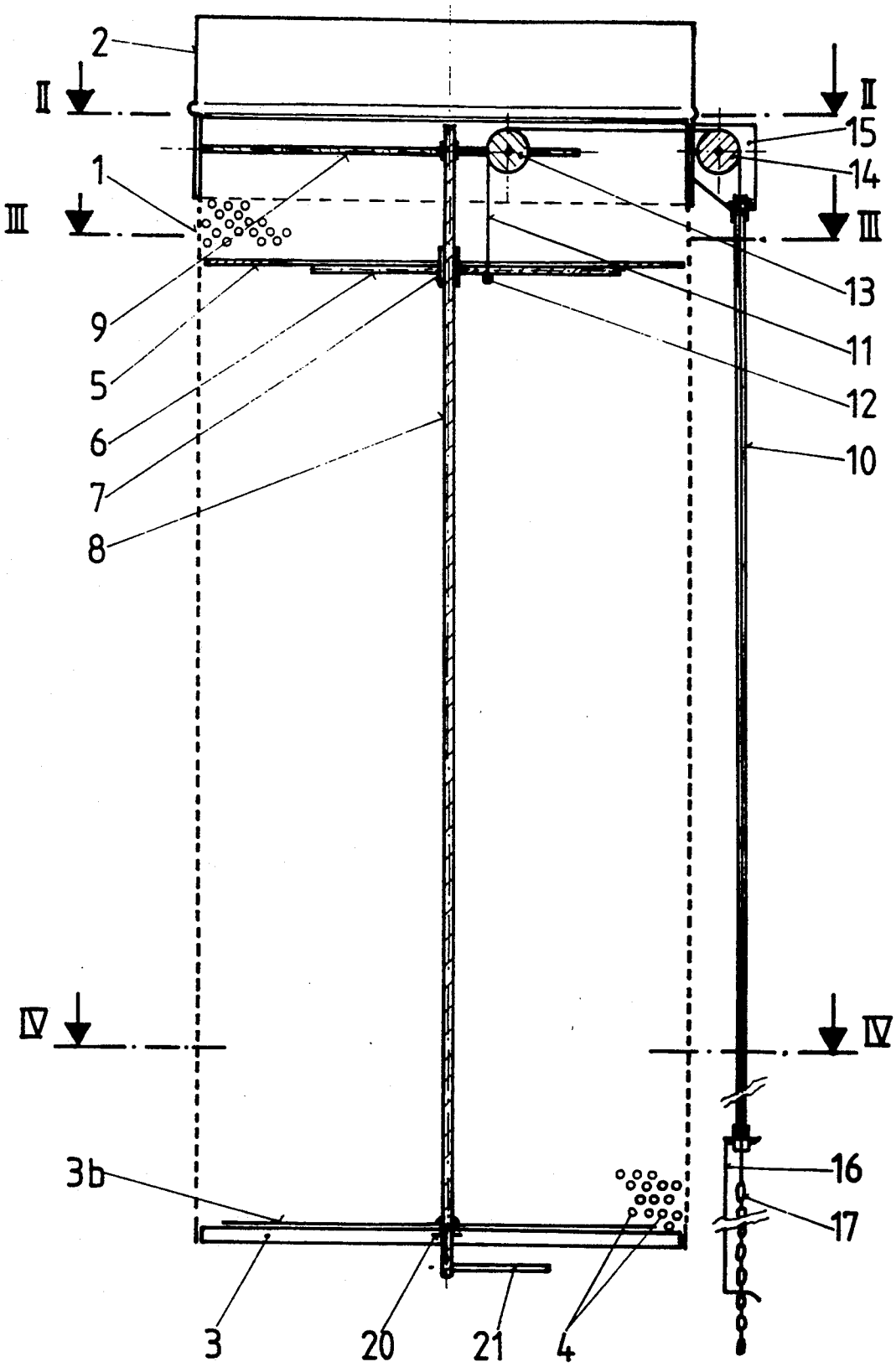
FIG. 1 is a longitudinal section through the air duct.
Figure 2:
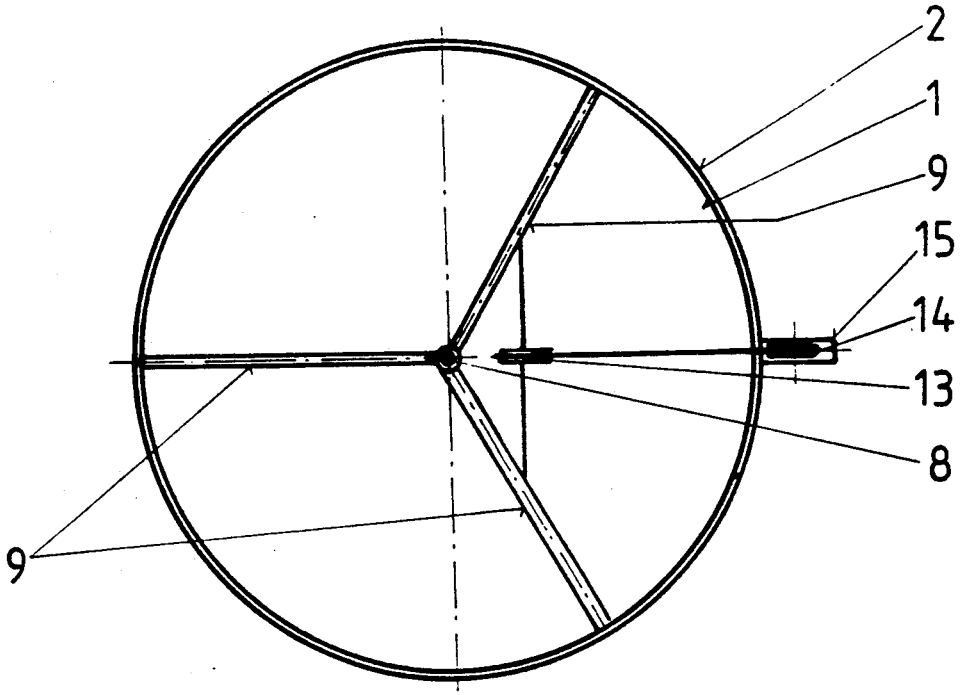
FIG. 2 is a section along the line II—II in FIGS. 1 and 14.

The illustrated air duct is preferably employed in industrial shops with high ceilings and can be adjusted to direct the jets of incoming air over the heads of the personnel when the air enters from above and directly over the floor or higher when it enters from below. The air duct is mounted perpendicular and has a cylindrical jacket 1 perforated with holes 4.

The air duct communicates by way of an air-intake connection with an unillustrated air-intake channel. Opposite air-intake connection 2, jacket 1 has a base 3 with air-outlet openings 3*a*. Above base 3 is a segmented disk 3*b* that rotates in relation to base 3. Since the segments in disk 3*b* and the air-outlet openings 3*a* in base 3 are identical in shape, size, and position, the openings can be opened and closed by rotating the disk.

The jacket 1 illustrated in FIGS. 1 to 4 accommodates a single annular diaphragm 5 that has a central aperture and rests against webs 6 and a positioning collar 7. Collar 7 loosely surrounds a central positioning rod 8, allowing diaphragm 5 to be raised and lowered to various heights within the perforated area of jacket 1.

Positioning rod 8 fits into segmented disk 3b and rotates around its longitudinal axis. It penetrates base 3 and is centered at the top by webs 9 secured to jacket 1. Positioning rod 8 is secured in base 3 by a tensioning ring 20.

Diaphragm 5 is raised and lowered by means of a Bowden mechanism 10 that contains a cable 11. Cable 11 travels over pulleys 13 and 14 and is secured by a terminal block 12 to a web 6. Bowden mechanism 10 is secured to a cable-adjustment access 16 mounted on one of the area's walls or uprights. Attached to the free end of cable 11 is a cable-adjustment chain 17. Diaphragm 5 can be raised and lowered by pulling or releasing the chain. Pulley 14 is accommodated in a block 15 that prevents cable 11 from coming out while being adjusted and is secured to the outside of jacket 1. Block 15 also keeps Bowden mechanism 10 in place. It is also possible to adjust the cable mechanically instead of manually, although the latter is the simplest approach.

The diaphragm 5 illustrated in FIG. 1 is positioned for the lower-temperature situation, wherein the radially exiting jets of air will as necessary flow up at an angle. In the standard heat-maintenance situation, diaphragm 5 will have been lowered farther, and the incoming air will flow out of the holes 4 in jacket 1 and down at a moderate to steep slope. When the area is to be heated up to regular elevated temperatures, it is only necessary to lower diaphragm 5 all the way down to the vicinity of base 3, allowing the incoming air to flow down to the floor at a steep slope.

When the area is to be heated up to highly elevated temperatures, the air-outlet openings 3a in base 3 will also be opened and the air will flow perpendicularly down to the floor and then radially out over the floor from the perpendicular. Diaphragm 5 can, however, be raised all the way up into air-intake connection 2 to more narrowly limit the overall pressure lost by the air.

When it is necessary to heat the area up to only slightly excess temperatures and when such a heat-up situation is to involve several centrally controlled air ducts, it is necessary to open only the air-outlet openings 3a in base 3 by way of levers 21. It is in this case unnecessary for diaphragm 5 to be lowered, and individual manual controls can be employed in conjunction with automatic heat-up.

Figure 5:
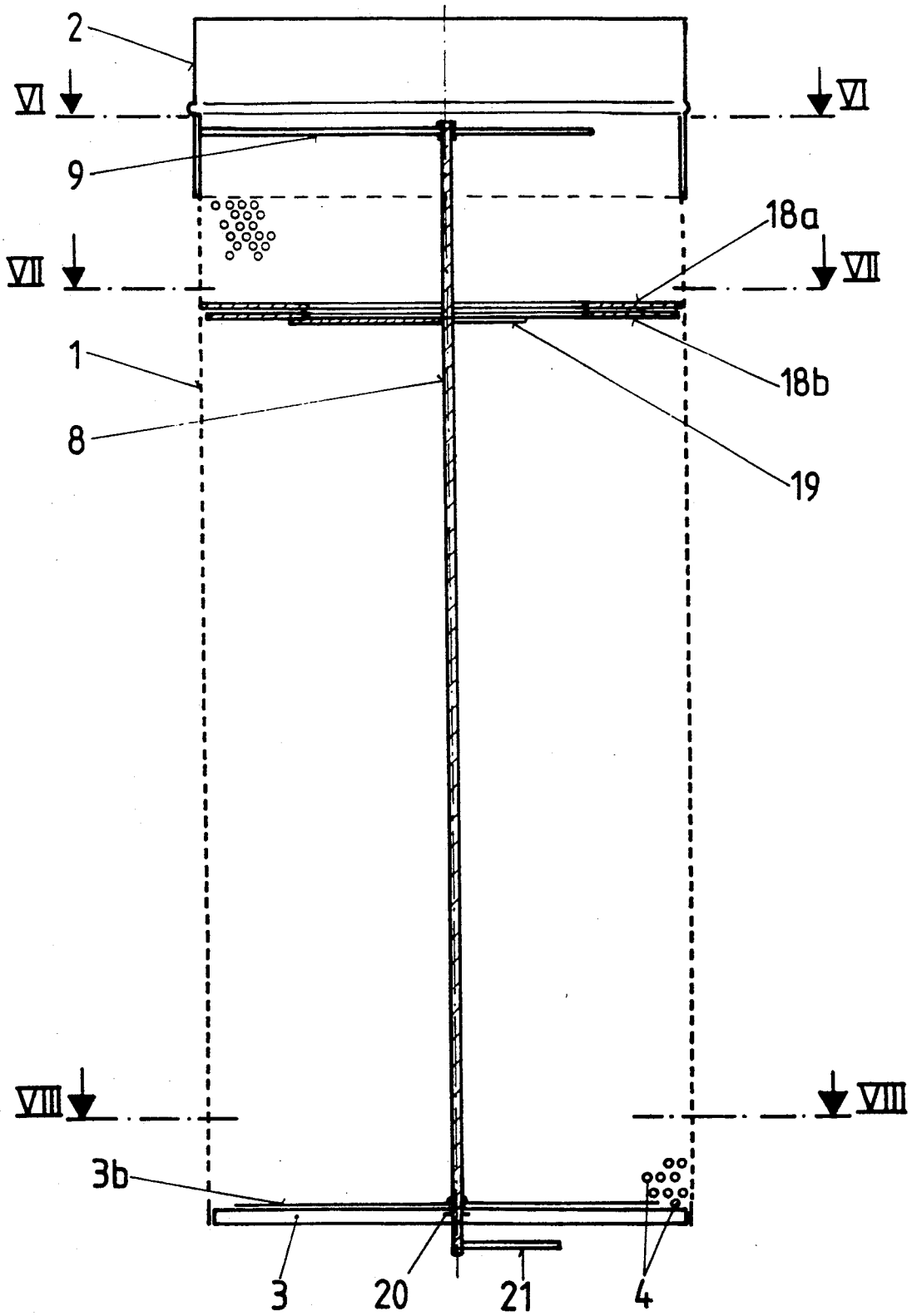
FIG. 5 is a longitudinal section through another embodiment of an air duct.
Figure 5A:
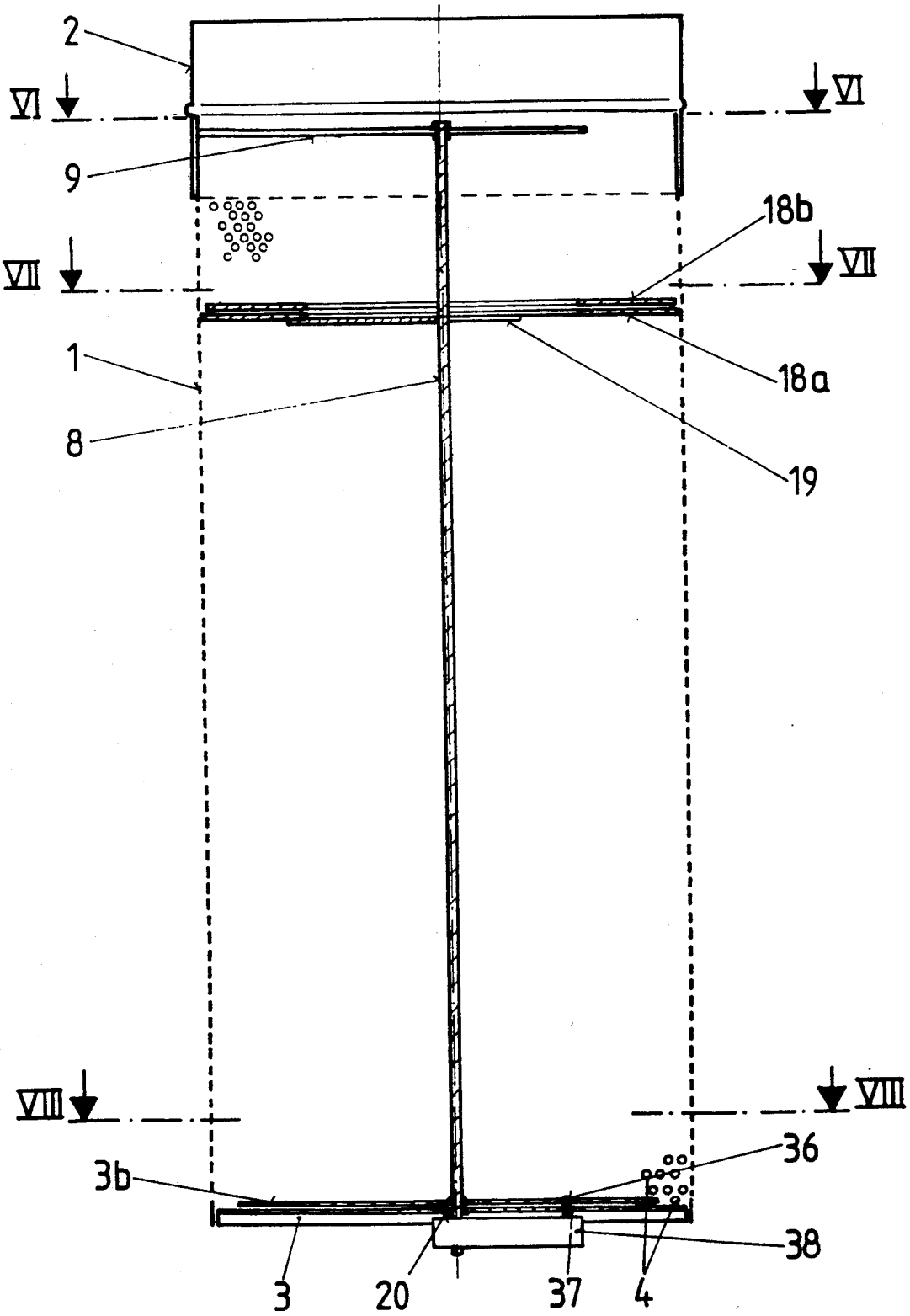
FIG. 5*a* is a longitudinal section through another embodiment.
Figure 6:
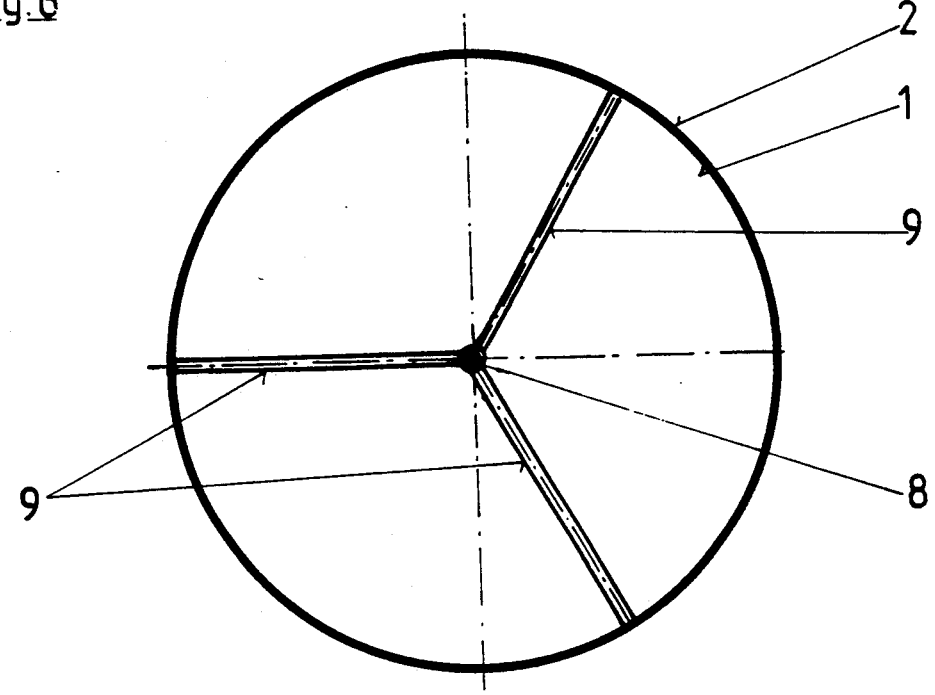
FIG. 6 is a section along the line VI—VI in FIGS. 5 and 15.

The air duct illustrated in FIGS. 5 through 8 is basically similar to the embodiment illustrated in FIGS. 1 through 4, although it employs a pair of annular diaphragms 18a and 18b. One such diaphragm, annular diaphragm 18a in FIG. 5, is secured at its circumference to jacket 1. Annular diaphragm 18b fits tightly against rotating central positioning rod 8 by way of webs 19. Both annular diaphragm 18b and segmented disk 3b can be activated by way of a lever 21 that engages positioning rod 8. Positioning rod 8 is centered at the top by webs 9 and secured in the base by tensioning ring 20.

Figure 7:
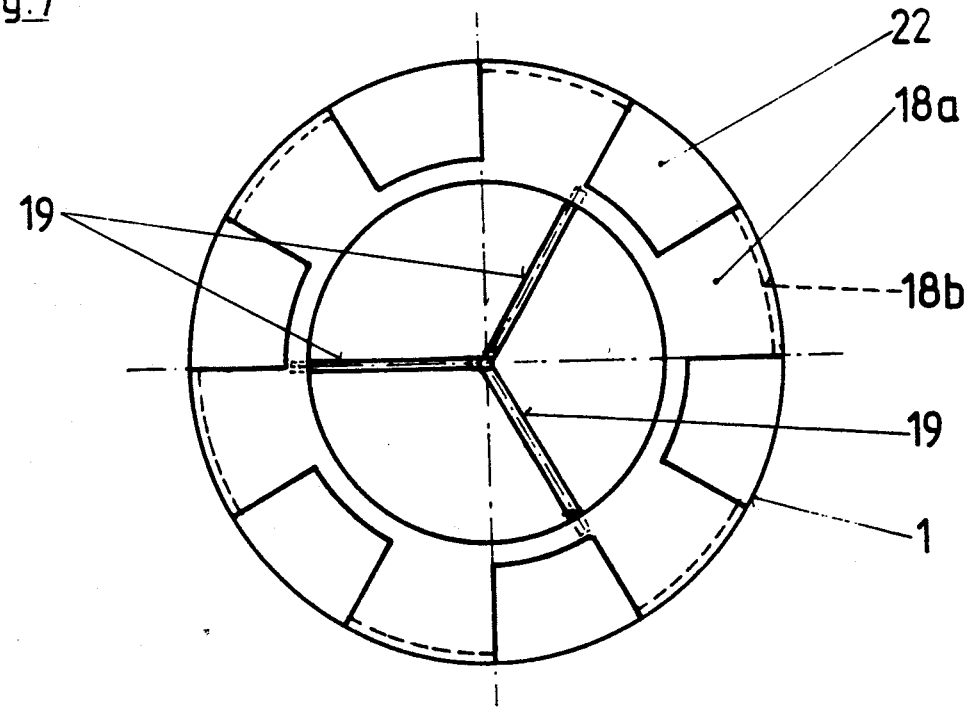
FIG. 7 is a section along the line VII—VII in FIGS. 5 and 15.
Figure 6A:
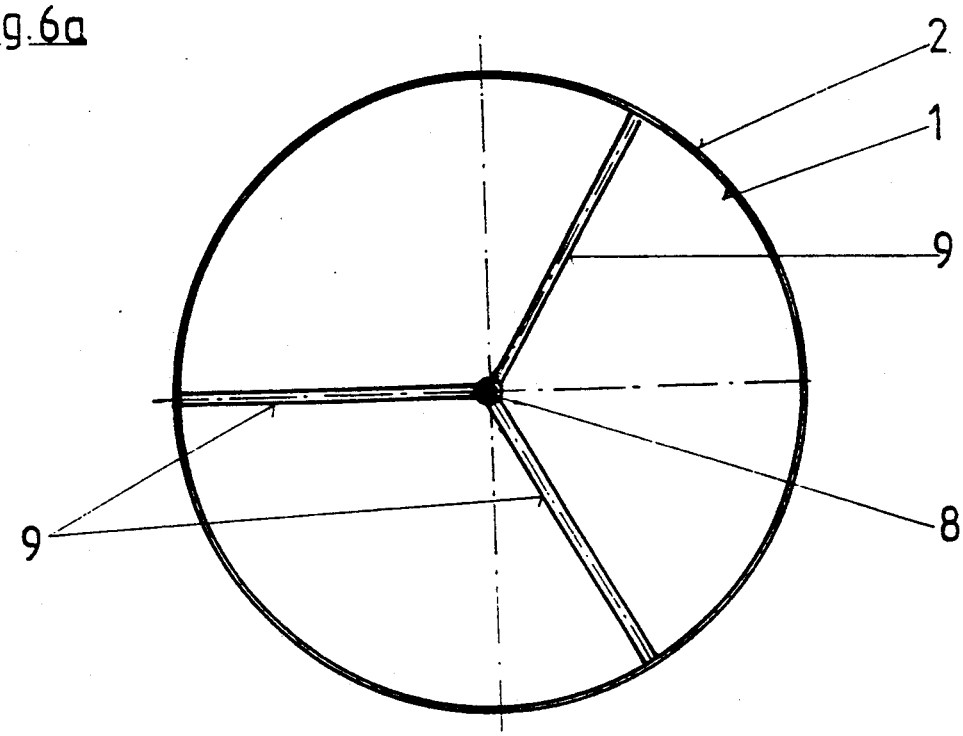
FIG. 6*a* is a section along the line VI—VI in FIGS. 5 and 15.
Figure 8:
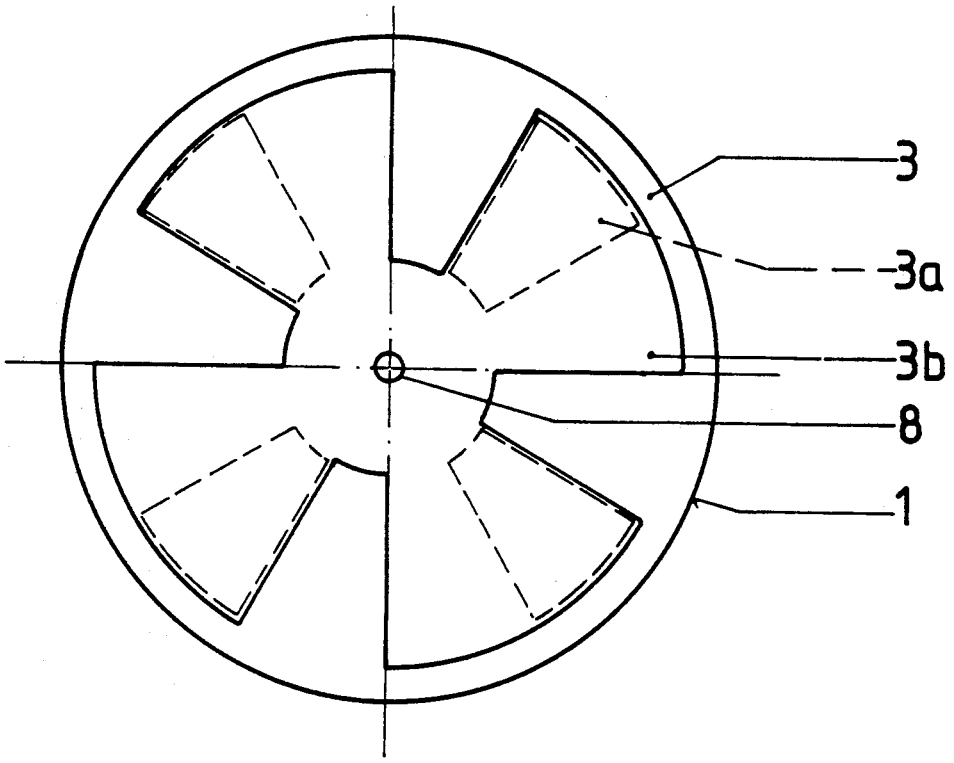
FIG. 8 is a section along the line VIII—VIII in FIGS. 5 and 15.

Annular diaphragms 18a and 18b have access openings 22 and solid segments that are identical in shape, size, and position. The access openings 22 in the annular diaphragms 18a and 18b in FIG. 7 are precisely aligned, the position that is to be established for maximal regular heat maintenance. The incoming air flows through access openings 22 and down at a steep slope. FIG. 8 represents the position of segmented disk 3b that is appropriate for this situation, with air-outlet openings 3a closed.

Figure 3:
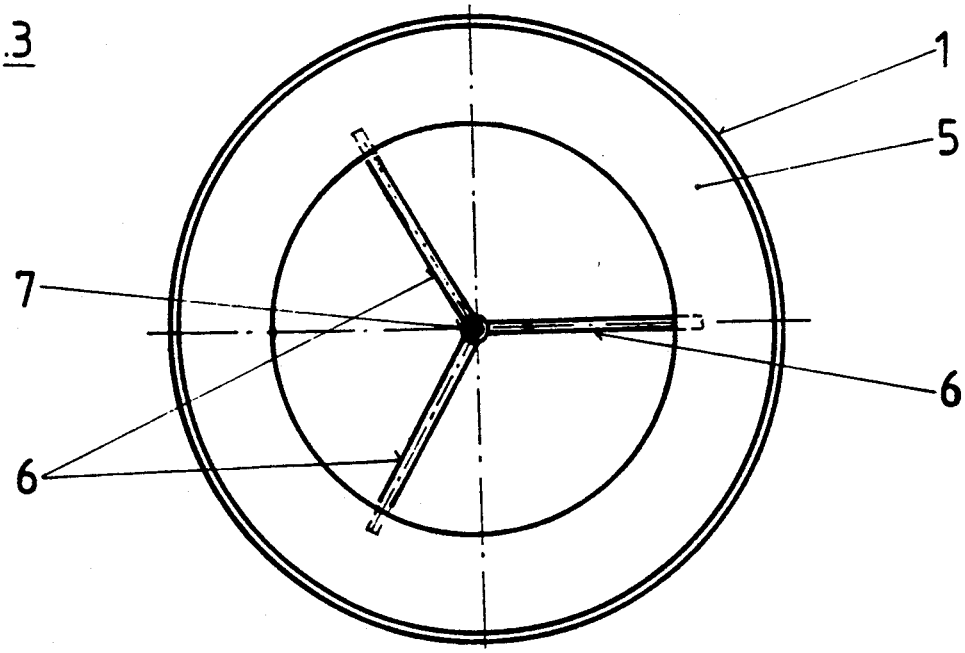
FIG. 3 is a section along the line III—III in FIGS. 1 and 14.
Figure 4:
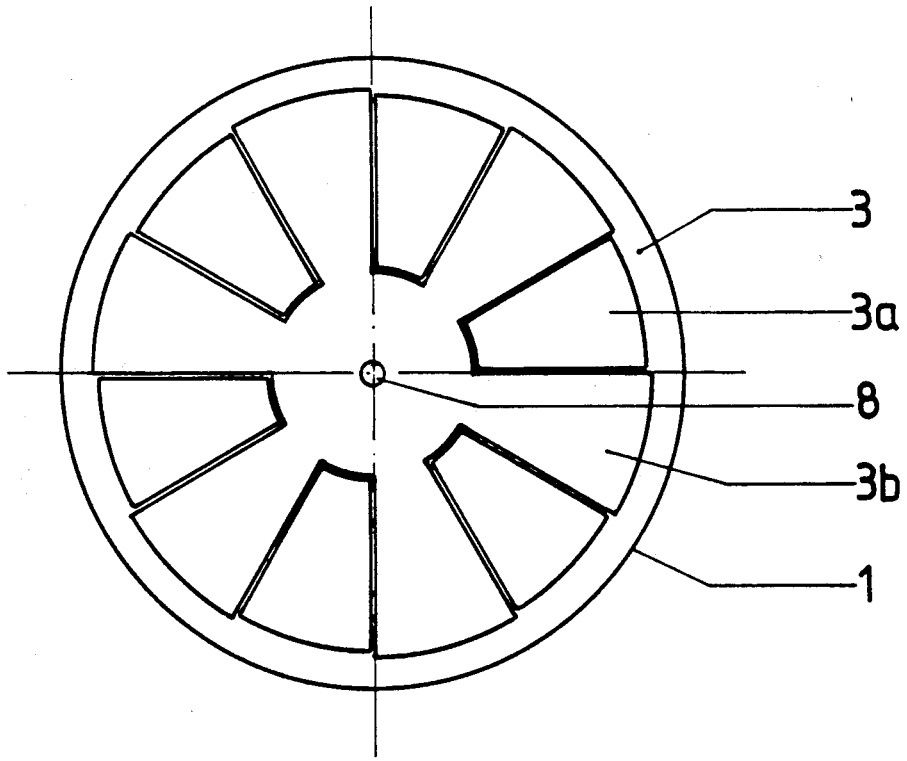
FIG. 4 is a section along the line IV—IV in FIGS. 1 and 14.

If moving annular diaphragm 18b is displaced far enough to the left as illustrated in FIG. 7 for access openings 22 to come into alignment with the solid segments, the practical result will be the integral diaphragm illustrated in FIG. 3. When annular diaphragms 18a and 18b are in this position, the incoming air in the lower-temperature situation will flow out of the jacket and up radially and at an angle. The segmented disk 3b illustrated in FIG. 8 is rotated to the left to the same extent. The air-outlet openings 3a in base 3 are again closed off by segmented disk 3b.

In heat-up situations with high incoming-air temperatures, annular diaphragm 18b and segmented disk 3b are rotated to the left out of the lower-temperature position as illustrated in FIGS. 7 and 8 until the access openings 22 in annular diaphragms 18a and 18b and the air-outlet openings 3a in base 3 are completely open. The incoming air will now flow down perpendicularly and then radially out from the perpendicular of the air outlet and over the floor. The adjustment can be either manual or mechanical.

The air duct illustrated in FIGS. 5a through 8a is basically similar in design to the duct illustrated in FIGS. 5 to 8, and differs only in its sequence of operations.

The positioning rod 8 illustrated in FIGS. 5a through 8a fits into annular diaphragm 18b by way of webs 19 without being secured to it. Base 3 and segmented disk 3b have central bores that the rod can rotate freely in.

Figure 7A:
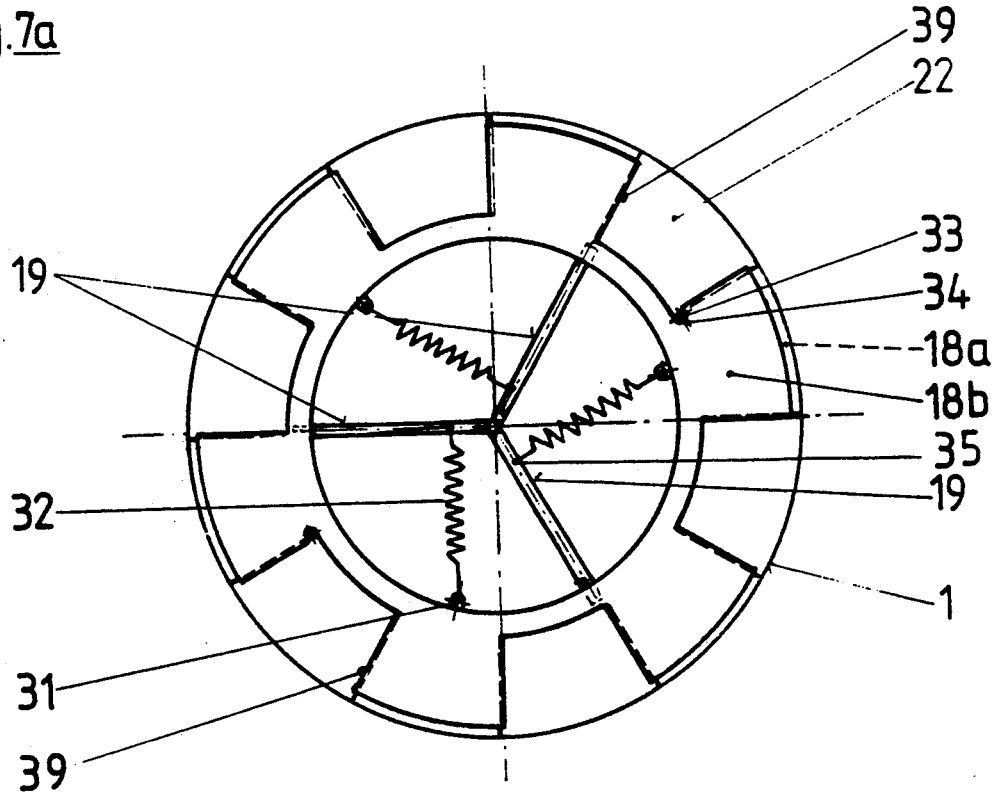
FIG. 7*a* is a section along the line VII—VII in FIGS. 5 and 15.

The stationary annular diaphragm 18a at the bottom in FIG. 7a also has eyes 31. Springs are stretched between the eyes at one end and bores 35 in the webs 19 in rotating annular diaphragm 18b at the other. Limiting pins are rigidly secured to stationary annular diaphragm 18a to ensure the tension and maintain moving annular diaphragm 18b in the limiting position illustrated in FIG. 7a. Limiting groove 34 allow access openings 22 to open completely.

Figure 8A:
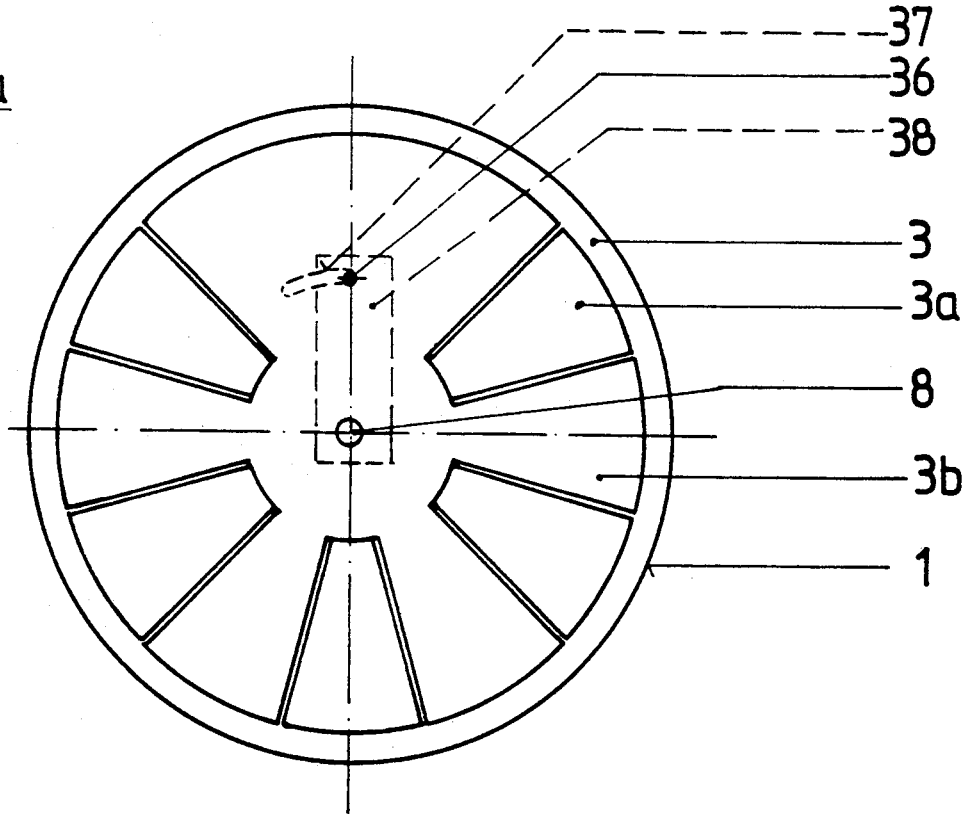
FIG. 8*a* is a section along the line VIII—VIII in FIGS. 5 and 15.

The base 3 with air-outlet openings 3a illustrated in FIG. 8a is secured to jacket 1. A slot 37 extends along the arc of a circle in base 3. A securing pin 36 rests in and is welded into a bore in segmented disk 3b. Securing pin 36 extends freely through slot 37 and is secured to a motor 38.

The driveshaft of slowly rotating motor 38 fits against rotating positioning rod 8.

FIGS. 7a and 8a illustrate the positions assumed by the disks when the area is to be heated up. Access openings 22 and air-outlet openings 3a are open all the way and all the incoming air with its high temperatures flows perpendicularly down along with the portion of the incoming air that leaves perforated jacket 1. The result is a combined jet of air, as is also true of all the other embodiments discussed herein by way of example.

The restoring force of springs 32 is more powerful than the most powerful frictional forces of the simultaneously moving parts of the air duct.

To establish the heat-maintenance situation, segmented disk 3b must be rotated until the air-outlet openings 3a in stationary base 3 close. This state is obtained by rotating the driveshaft of the motor illustrated in FIG. 8a clockwise. Since, however, springs 32 are more powerful than the friction, the shaft will not rotate in the motor, and the motor will rotate counterclockwise around its own shaft until securing pin 36, which is at the left end of the slot 37 in stationary base 3, stops it, at which time the heat-maintenance situation will have been obtained and the incoming air will flow down steeply out of the perforated jacket.

If the rotation of the drive mechanism is retained, the motor shaft must now necessarily rotate clockwise with positioning rod 8 resting against it because securing pin 36 is blocking it. Annular diaphragm 18*b* will accordingly also rotate clockwise as illustrated in FIG. 7*a* until the edge 39 of annular diaphragm 18*b* comes into contact with limiting pin 33. Access openings 22 will now be closed and the maximal low-temperature situation will have been attained. The incoming air will now flow up and at a angle out of the air duct.

If the rotation is reversed, the access openings 22 in annular diaphragms 18*a* and 18*b* will open before the air-outlet openings 3*a* in base 3.

This sequence of operations makes it possible for the first time to employ simple and automatic conventional temperature-difference controls with no need for two motors. These temperature-difference controls must only emit signals for motion to the right for the low-temperature situation and for motion to the left for the heat-maintenance and heat-up situations. This can be achieved with a control signal of 0–10 V.

Figure 15:
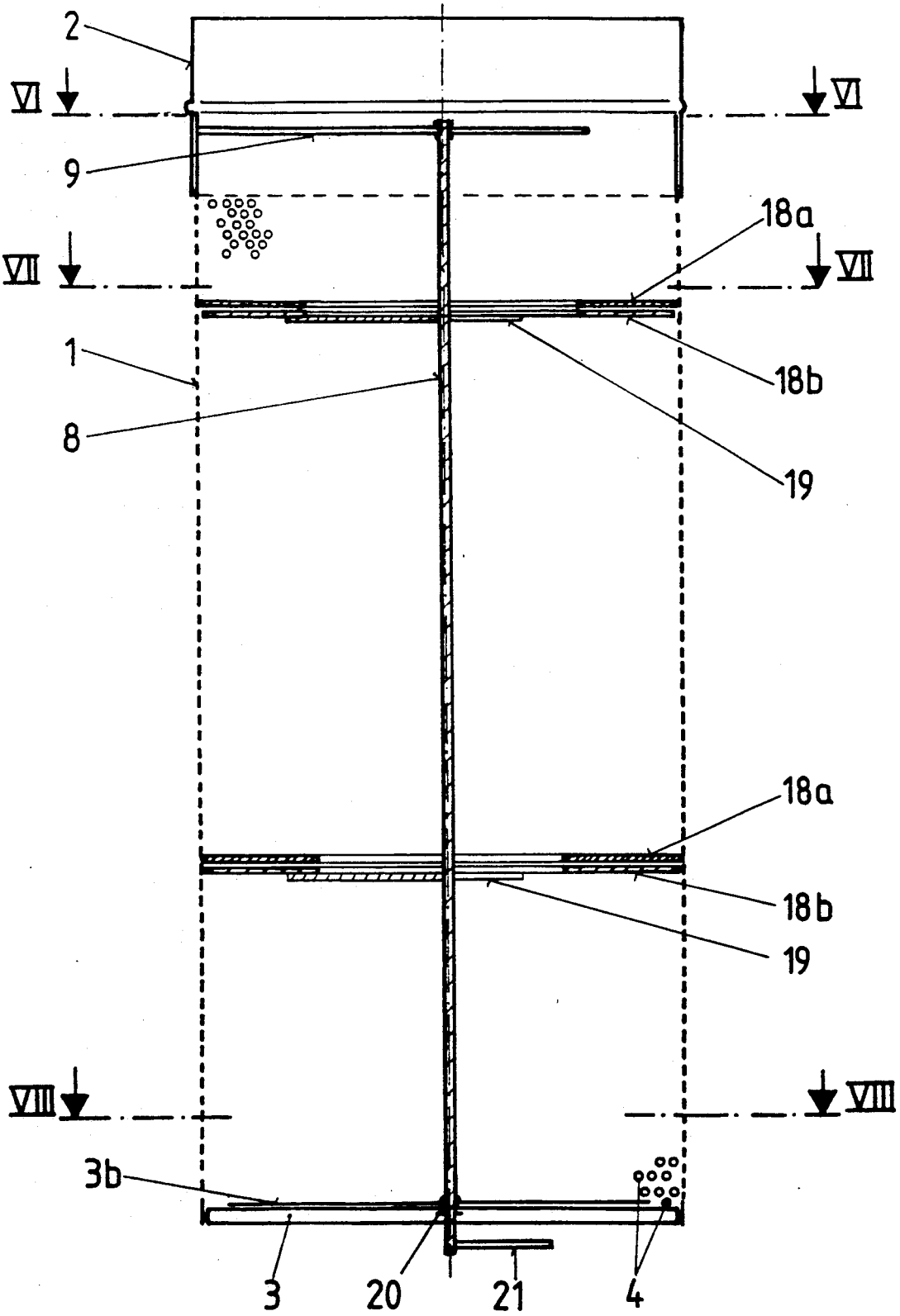
FIG. 15 is a longitudinal section through the outlet of another embodiment.

The air duct illustrated in FIGS. 5*a* to 8*a* and just described can also be equipped with several pairs of annular diaphragms 18*a* and 18*b* as illustrated in FIG. 15. When there are several pairs, all the moving annular diaphragms 18*b* are secured to each other and to positioning rod 8. Springs 32 are necessary only in one pair of diaphragms.

Figure 9:
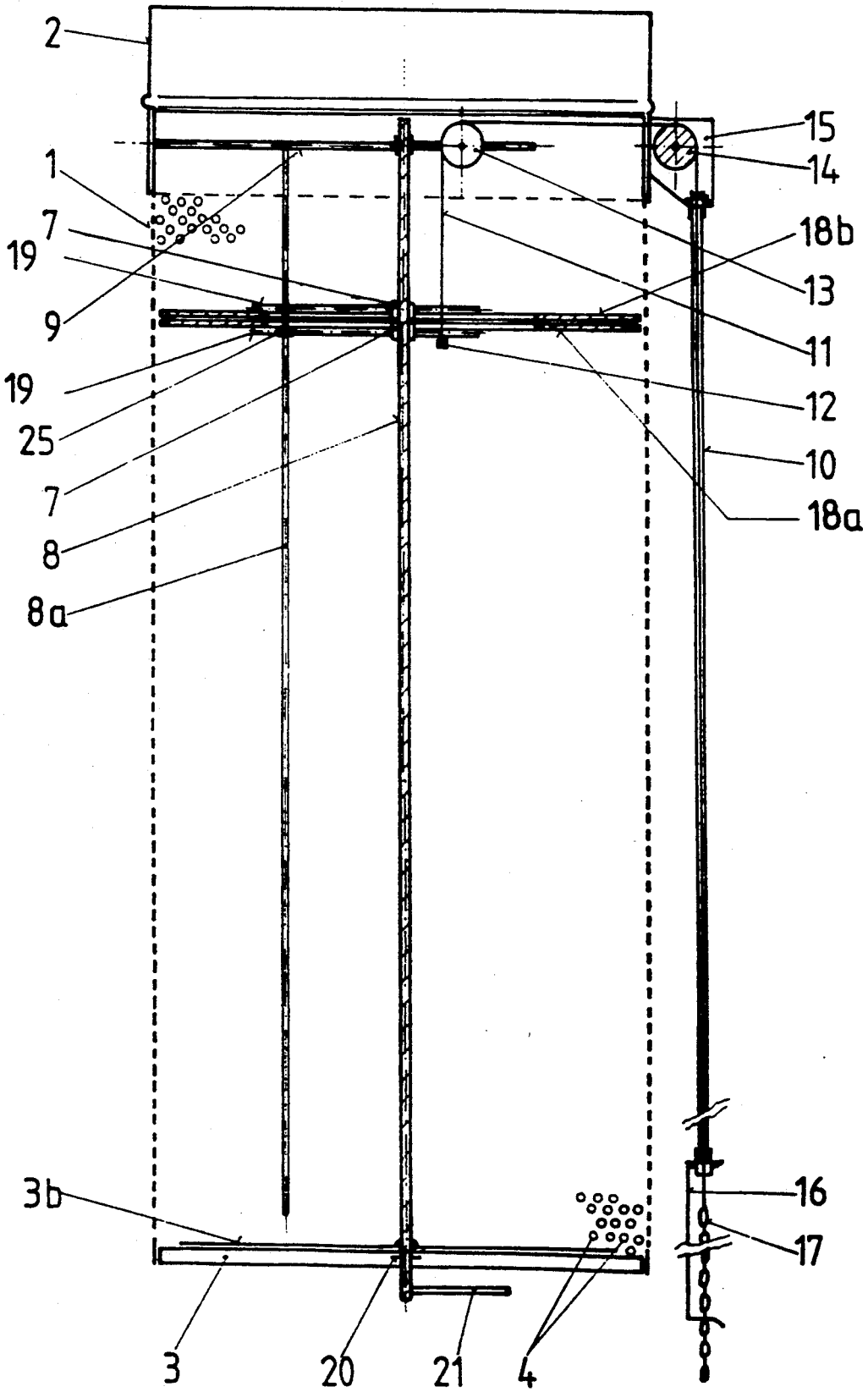
FIG. 9 is a longitudinal section through another embodiment.

The annular diaphragms 18*a* and 18*b* in the embodiment illustrated in FIG. 9 can be rotated by positioning rod 8 and raised and lowered by Bowden mechanism 10 to optimize air deflection in extreme or particular situations. The annular diaphragms 18*a* and 18*b* in this embodiment can all be displaced along positioning rod 8 by Bowden mechanism 10 as described in detail with reference to FIG. 1. An additional positioning rod 8*a* prevents annular diaphragm 18*b* from rotating. Additional positioning rod 8 is rigidly secured to the web 9 that centers positioning rod 8, and extends through a positioning eye 25 mounted on one of the webs 19 in annular diaphragm 18*a*.

Positioning rod 8 also has a longitudinal positioning groove that accommodates a positioning pin on the collar 7 of annular diaphragm 18*b* , making it possible for lever 21 to rotate annular diaphragm 18*b*. The functions of annular diaphragms 18*a* and 18*b*, segmented disk 3*b*, and base 3 with its air-outlet openings 3*a* are as described with reference to FIGS. 5 to 8.

Figure 10:
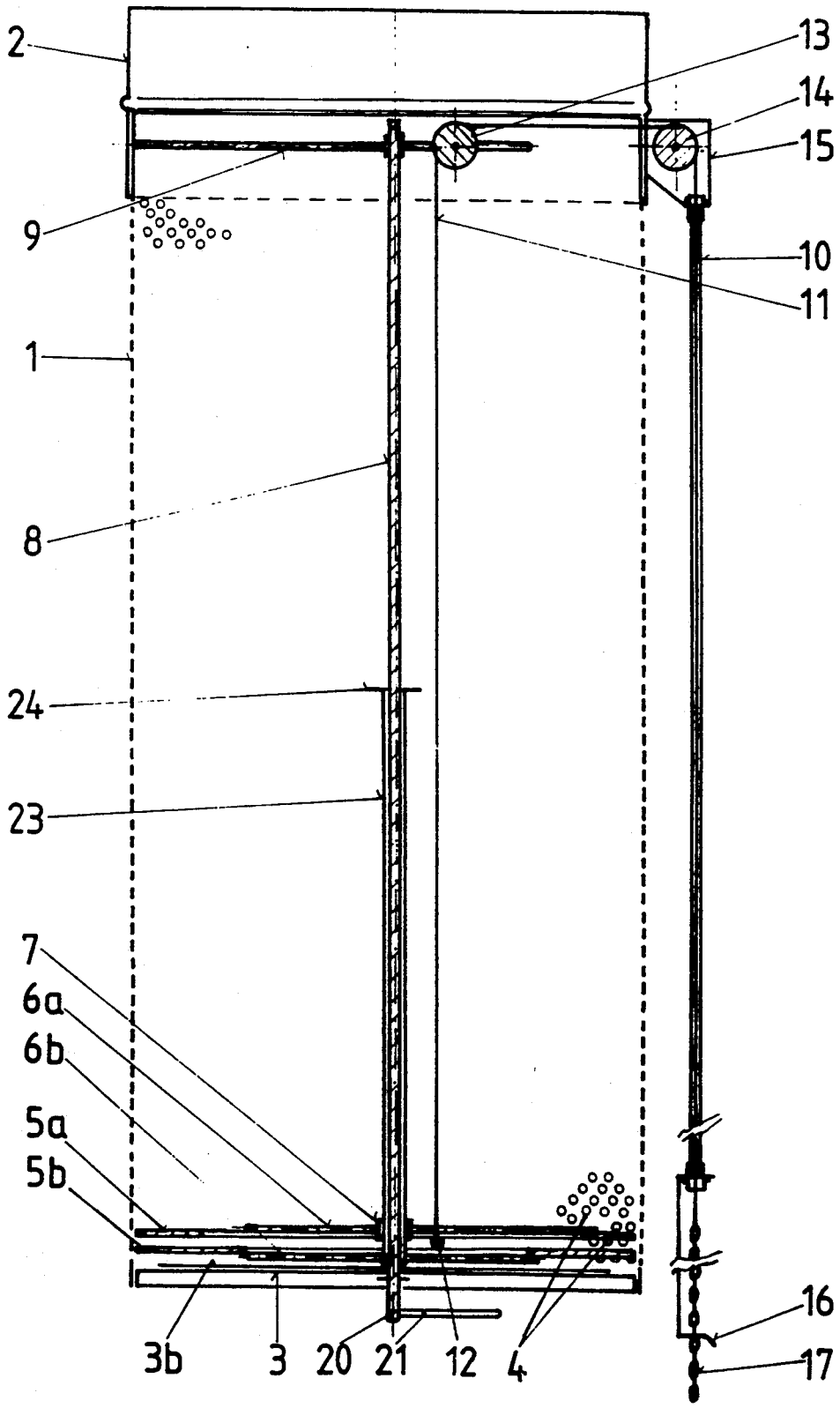
FIG. 10 is a longitudinal section through another embodiment.

The air duct illustrated in FIG. 10 is also basically similar in design to those illustrated in FIGS. 1 through 4, although the vertically adjustable diaphragm 5 has been replaced with a pair of annular diaphragms 5*a* and 5*b*. The diaphragms illustrated in FIG. 10 are in the heat-up position as described with reference to the embodiment illustrated in FIGS. 1 to 4. Annular diaphragms 5*a* and 5*b* are accordingly in the lowermost position and have the same effect as a single diaphragm 5.

The upper diaphragm 5*a* constitutes in conjunction with webs 6*a* and collar 7 a unit that can be raised and lowered by the cable 11 in Bowden mechanism 10 on a tube 23 that slides up and down on positioning rod 8. Lower diaphragm 5*b* constitutes in conjunction with webs 6*b* and pipe 23 a unit that can be raised and lowered. If diaphragm 5*a* is raised high enough for collar 7 to come into contact with a flange 24 around tube 23 and continues to rise, it will also lift diaphragm 5*b*. Diaphragm 5*a* will be at the top in the maximal low-temperature situation.

The embodiment illustrated in FIG. 10 ensures optimal air channeling not only in a heat-up situation that involves extensive temperature differences but also for the extremely low-temperature situation and for all the intermediate thermal-load situations. Diaphragm 5*b* ensures an additional advantage for extremely low-temperature situations in that the incoming air will flow out and up at a greater angle and the differences between the temperature of the incoming air and that of the ambient air can resolve themselves better over the long distance traveled by the jets before arriving in the area occupied by the personnel. Base 3 can be opened for heat-up situations that involve extreme temperatures.

Figure 11:
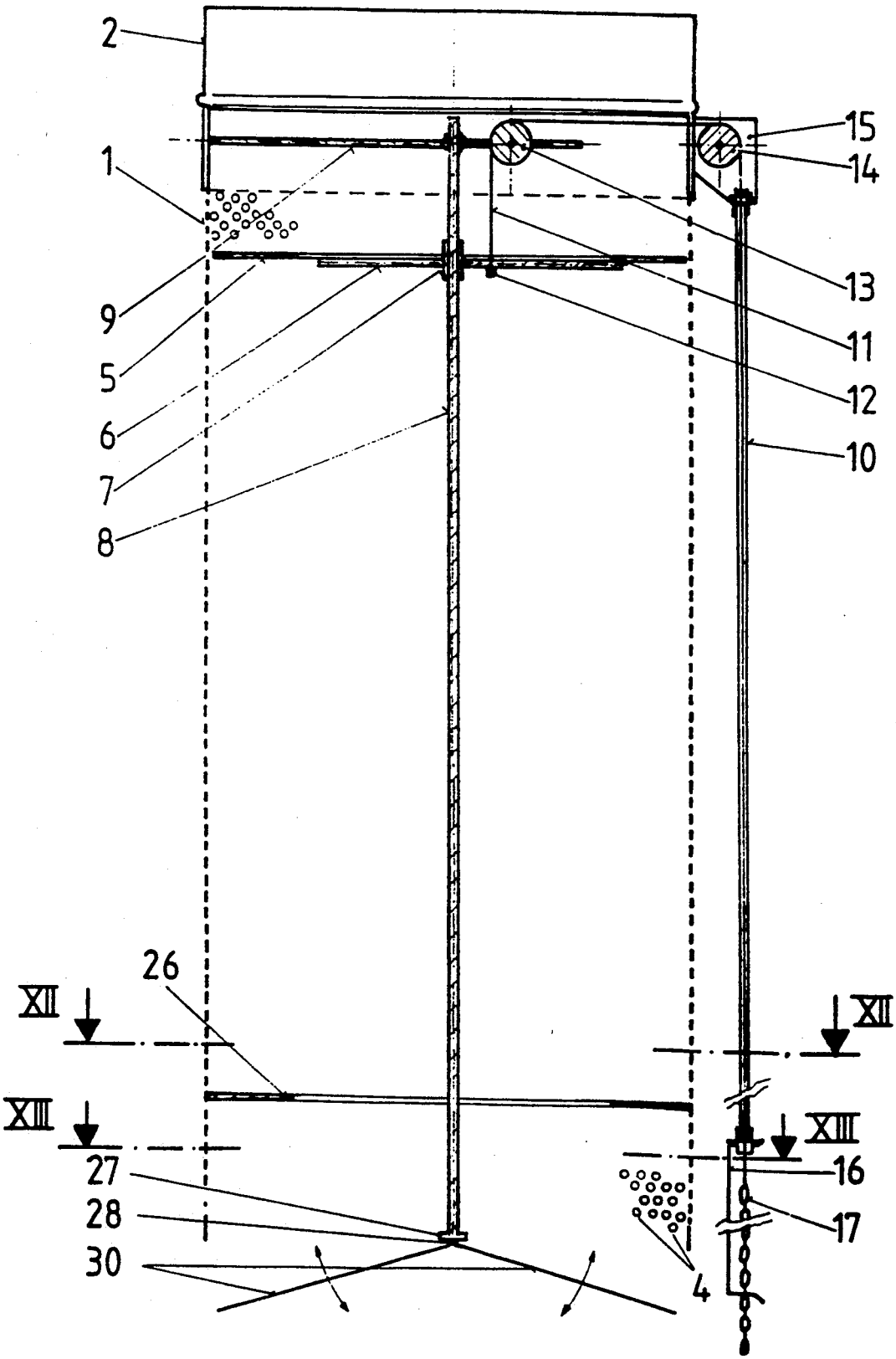
FIG. 11 is a longitudinal section through another embodiment.
Figure 12:
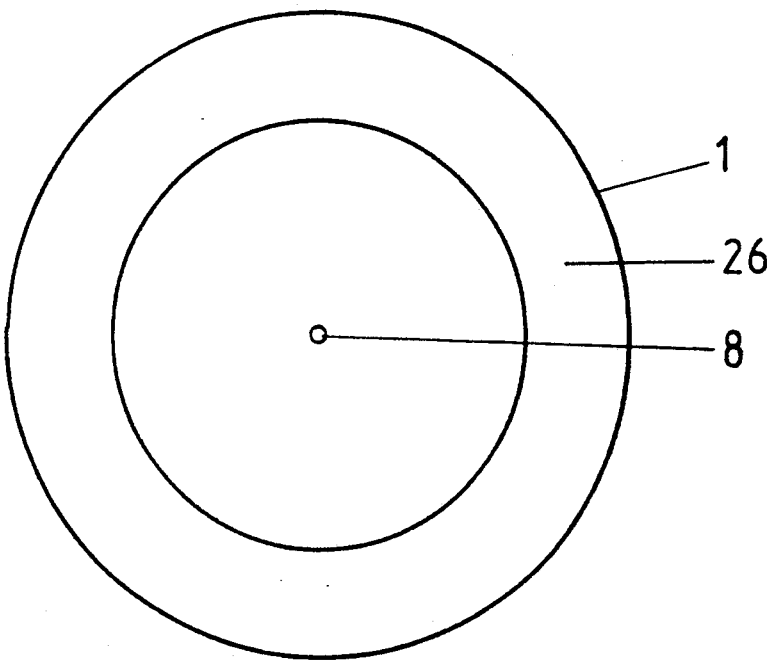
FIG. 12 is a section along the line XII—XII in FIG. 11.

The air duct illustrated in FIGS. 11 and 12 is basically similar in design and function to the one described with reference to FIGS. 1 to 4, although it also includes an annular diaphragm 26 rigidly secured to jacket 1. A stationary diaphragm 26 of this kind can also be built into the air duct illustrated in FIG. 5. Diaphragm 26 also helps to lift the emerging jets of air in the low-temperature situation. The positions of diaphragms 5 and 26 can be interchanged without affecting the principle of the flow conditions. The diaphragm 26 illustrated in FIGS. 11 and 13 will have the same effect in the air duct illustrated in FIG. 9.

Figure 13:
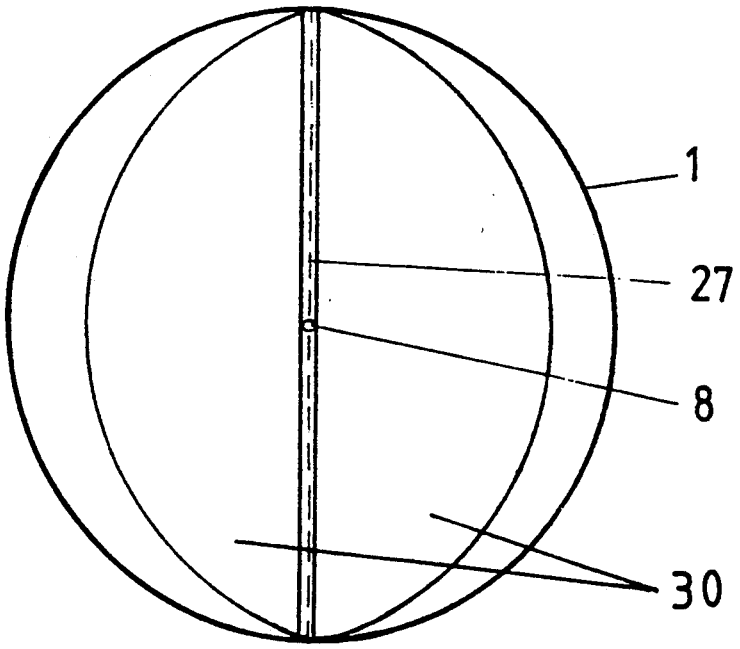
FIG. 13 is a section along the line XIII—XIII in FIG. 11.

The base 3 is replaced by two pivoting semicircular shutters 30 in the embodiment illustrated in FIGS. 11 to 13. Shutters 30 pivot around a point 28 represented by hinges 27 secured to positioning rod 8. In heat-up situations that involve extremely high temperature, the shutters are pivoted up to open the base of the air duct. The shutters can also consist of more than two panels that deflect the air.

Figure 14:
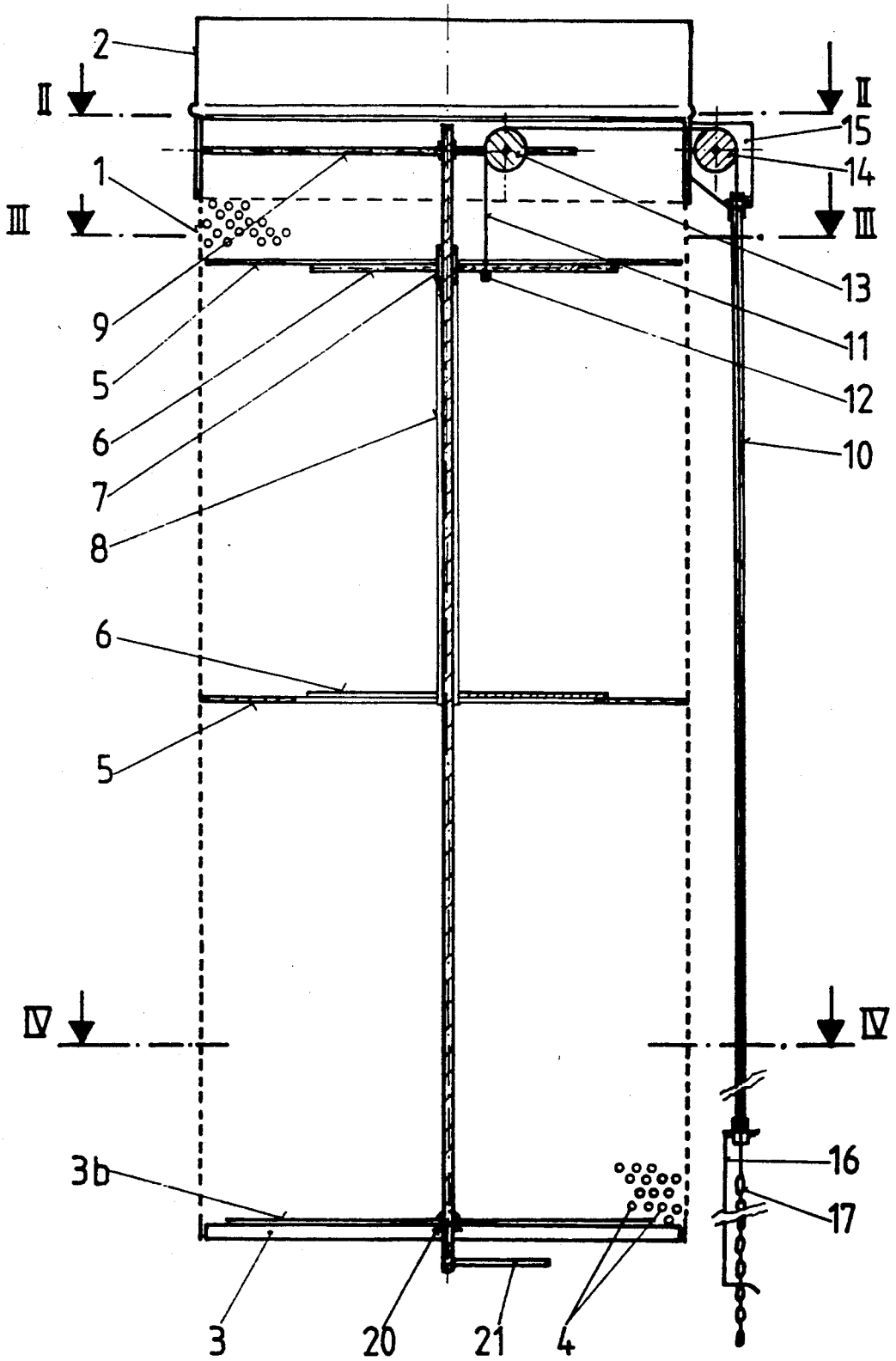
FIG. 14 is a longitudinal section through another embodiment.
Figure 16:
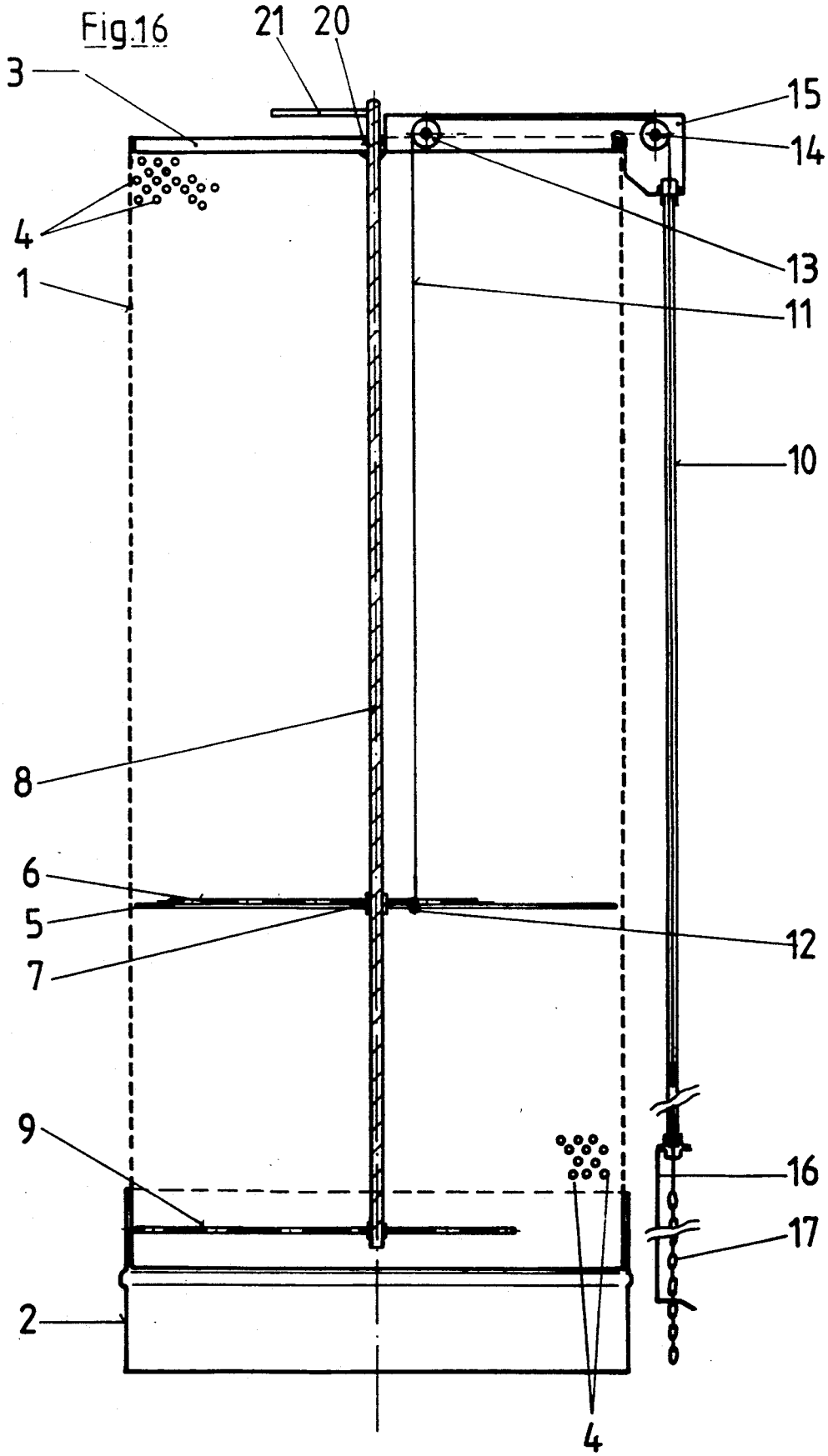
FIG. 16 is a longitudinal section through an outlet aimed at an angle that differs by 180°.

The air duct illustrated in FIG. 14 is similar in principle to the air duct illustrated in FIGS. 1 to 4, although collar 7 has been extended to accommodate another diaphragm 5. Second diaphragm 5 is rigidly secured to collar 7. It has a positive effect in extreme low-temperature situations. The air duct illustrated in FIG. 15 is similar in principle to the air duct 15 illustrated in FIGS. 5 through 8*a* although it has an additional pair of annular diaphragms. This air duct also has a positive effect in extreme low-temperature situations. The incoming air arrives in all the embodiments illustrated in FIGS. 1 to 15 from above. When the air is introduced from below, the air ducts must be rotated 180×. Pulleys 13 and 14 and block 15*a* are accordingly mounted on base 3 outside the air duct. The Bowden mechanism operates in the opposite direction, as illustrated in FIG. 16.

Figure 17:
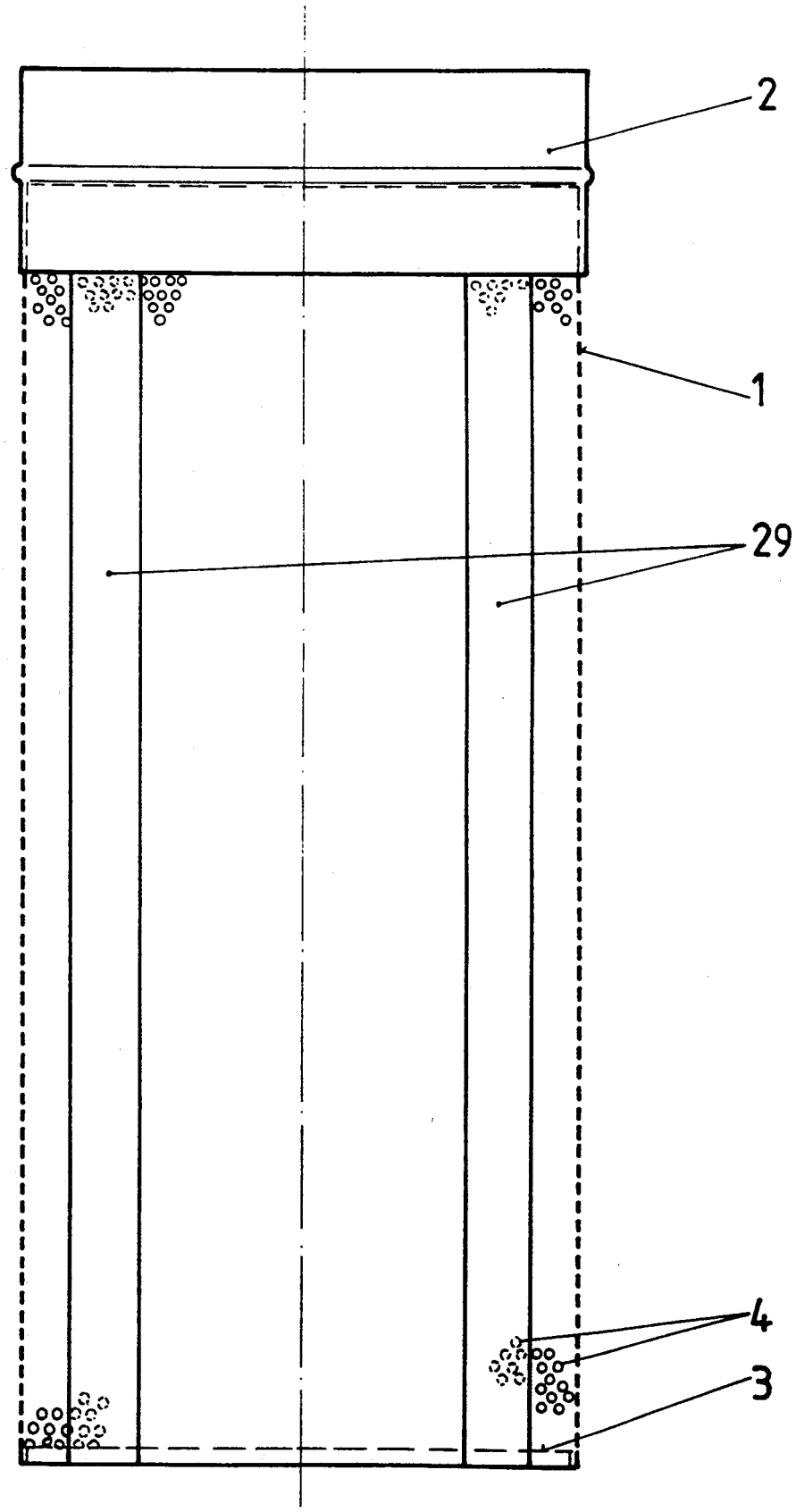
FIG. 17 is a side view of an air duct with cover strips.

As will be evident from FIG. 17, the jacket 1 of any of the embodiments of the air duct illustrated and described herein can for specific purposes be provided with cover strips 29. These strips are employed when various prescribed ranges must be adhered to in various radial jet orientations. When there are permanent work sites directly in front of the air duct, cover strips 29 can be employed to achieve a segment-by-segment recess into which no air is blown and the work site also maintained free of drafts.

Although all the air ducts represented herein have a cylindrical jacket, they need not necessarily be cylindrical and may also be conical or rectangular. The cylinder, however, is preferred because it is less expensive.

I claim:

1. An air duct comprising: a perforated cylindrical jacket having two ends; an air-intake connection at one end of said cylindrical jacket; a base at the other end of said cylindrical jacket opposite said air-intake connection at said one end; a single pair of two annular diaphragms within said jacket and having access openings that are identical in size, shape and position to form shutters for closing said openings; one of said diaphragms being secured stationary in said jacket and the other of said diaphragms rotating in said jacket relative to the one diaphragm.

2. An air duct as defined in claim 1, including a plurality of pairs of annular diaphragms rotatable in opposite directions within said jacket; said base having air-outlet openings, means for opening and closing said air-outlet openings.

3. An air duct as defined in claim 2, including a segmented disk above said base for closing off at least partly said air-outlet openings; a central positioning rod rotatable in said jacket; said other of said diaphragms rotating in said jacket having webs, said webs and said segmented disk being secured to said central positioning rod.

4. An air duct as defined in claim 3, wherein said air-outlet openings in said base remain closed when said other of said diaphragms rotating in said jacket and said segmented disk rotate together and said access openings being open or closed.

5. An air duct as defined in claim 3, wherein said access openings and said air-outlet openings in said base open simultaneously when said other of said diaphragms rotating in said jacket and said segmented disk rotate together.

6. An air duct as defined in claim 1, including a central positioning rod rotatable in said jacket; said other of said diaphragms rotating in said jacket having webs for securing said other of said diaphragms rigidly to said positioning rod; and a segmented disk above said base and rotatable separately from said other of said diaphragms.

7. An air duct as defined in claim 1, including springs between said one of said diaphragms and said other one of said diaphragms; limiting pins on said other of said diaphragms and extending into limiting grooves; a securing pin extending in a slot; a segmented disk above said air-outlet openings in said base; only one motor for moving said segmented disk and said other of said diaphragms in opposite directions and in predetermined sequence in one direction of rotation, said motor rotating in a reverse direction when said sequence is reversed.

8. An air duct as defined in claim 7, wherein said motor has a drive shaft, said motor rotating said drive shaft and rotating also in sequence around said drive shaft.

9. An air duct as defined in claim 1, including means for displacing said two annular diaphragms axially over the length of said jacket.

10. An air duct comprising: a perforated cylindrical jacket having two ends; an air-intake connection at one end of said cylindrical jacket; a base at the other end of said cylindrical jacket opposite said air-intake connection at said one end; at least one annular diaphragm slidable axially within said jacket; and means for moving said diaphragm axially back and forth, means for opening and closing said air-outlet openings, said annular diaphragm having a central opening, a portion of air admitted into said jacket passing through said central opening of said diaphragm and exiting through said air-outlet openings in said base, said diaphragm forming a vacuum pressure within space between said diaphragm and said base for deflecting air exiting at an angle with respect to said air-outlet openings, said annular diaphragm having a lowermost position for deflecting said air substantially vertically downward.

11. An air duct as defined in claim 10, including a plurality of separated diaphragms slidable axially back and forth within said jacket.

12. An air duct as defined in claim 11, including a rotatable segmented disk above said base and having a plurality of segments; said air-outlet openings in said base being at least partly closeable by said segments.

13. An air duct as defined in claim 11, including an upper diaphragm and a lower diaphragm, said lower diaphragm being positioned adjacent said base and telescoping with said upper diaphragm so that said upper diaphragm moves up and down independently of position of said lower diaphragm over a predetermined distance.

14. An air duct as defined in claim 10, including an additional diaphragm rigidly secured to said jacket.

15. An air duct as defined in claim 10, including cover strips mounted on said jacket.

16. An air duct as defined in claim 10, wherein said air-intake connection is located above said base and air passing through said air-intake connection flowing downward.

17. An air duct as defined in claim 10, wherein said jacket is positioned so that said base is at top of said jacket and said air-intake connection is located below said base, air passing through said air-intake connection flowing upward.

18. An air duct comprising: a perforated cylindrical jacket having two ends; an air-intake connection at one end of said cylindrical jacket; a base at the other end of said cylindrical jacket opposite said air-intake connection at said one end; a single annular diaphragm slidable axially within said jacket; and means for moving said diaphragm axially back and forth within said jacket; air streams passing through the jacket perforations forming an angle with the horizontal dependent on the air pressure with said jacket and adjacent said perforations; said base having air-outlet openings that can be opened and closed, said annular diaphragm having a central opening, a portion of air admitted into said jacket passing through said central opening of said diaphragm and exiting through said air-outlet openings in said base, said diaphragm forming a vacuum pressure within space between said diaphragm and said base for deflecting air exiting at an angle with respect to said air-outlet openings, said annular diaphragm having a lowermost position for deflecting said air substantially vertically downward.

* * * * *